US005352155A

United States Patent [19]

Fahey

[11] Patent Number: 5,352,155

[45] Date of Patent: Oct. 4, 1994

[54] DUAL IMPRESSION APPOINTMENT REMINDER

[76] Inventor: Patrick S. Fahey, 15217 Lloyd Cir., Omaha, Nebr. 68144

[21] Appl. No.: 966,418

[22] Filed: Oct. 26, 1992

[51] Int. Cl.[5] ..... B42D 15/00; B41L 1/22

[52] U.S. Cl. ..... 462/25; 462/67; 283/81; 283/900

[58] Field of Search ..... 283/81, 900; 462/67, 462/25

[56] References Cited

U.S. PATENT DOCUMENTS

| | | | |
|---|---|---|---|
| 3,960,634 | 6/1976 | Kempster | 156/277 |
| 4,016,664 | 4/1977 | Kaufmann | 40/10 |
| 4,029,341 | 6/1977 | Neill et al. | 282/22 |
| 4,159,129 | 6/1979 | Lockhart | 282/27 R |
| 4,159,586 | 7/1979 | Blum | 40/2 R |
| 4,177,089 | 7/1981 | Lockhart | 282/27 R |
| 4,799,712 | 1/1989 | Biava et al. | 282/1 A |
| 4,830,407 | 5/1989 | Sadler, Jr. et al. | 283/102 |
| 5,026,196 | 6/1991 | Brass | 402/79 |
| 5,240,456 | 8/1993 | Ochiai | 462/67 |

*Primary Examiner*—Paul A. Bell
*Attorney, Agent, or Firm*—John A. Beehner

[57] ABSTRACT

A dual impression appointment reminder is made from a two-ply form having a face stock releasably secured by an adhesive onto a release liner of a material such that, upon writing information on the face stock with an impression writing instrument, a copy of that information is simultaneously made on the liner. The face stock includes a removable label at least partially defined by a peripheral cut. The removable label is attachable by adhesive on the underside of it to another surface, such as a calendar. Both the face stock and label have permanent printed information thereon so that upon writing the date and time of an appointment on the label with an impression writing instrument, and upon removal of the label from the liner, two separate reminders are provided with the date and time of the appointment recorded on each of them.

21 Claims, 4 Drawing Sheets

DUAL IMPRESSION APPOINTMENT REMINDER

BACKGROUND OF THE INVENTION

Technical Field

The present invention is directed generally to appointment reminder cards and more particularly to an apparatus and method by which a service provider may provide a patient with two reminders of a scheduled appointment by recording the appointment information once on a removable adhesive backed label on an appointment card such that a dual impression of the appointment information is made simultaneously on the label and the card.

A significant problem for doctors, dentists, and any service providers who schedule appointments for their patients, clients, or customers is the high cost and lost revenue opportunities that results from missed appointments. If they have reserved time for a particular patient and the patient does not show up, that time may be unproductive if it cannot be filled with another patient such as an emergency.

Typically, doctor and dentist offices hand out a business card sized card with appointment information on it as a reminder to assist patients in keeping scheduled appointments. That card is often placed in a wallet, pocket calendar or the like with other business cards where it is rendered ineffective as a reminder unless the patient happens to check the card again before the appointment.

Furthermore, missed appointments may result from transcription errors by the patient transferring the data from the appointment card onto a personal planning calendar. The chances of transcription errors are generally proportional to the amount of information that must be transferred.

The above described problems with written appointment reminders are not exclusive to business service providers as they are also applicable to party announcements and other social invitations, for example.

Accordingly, a primary object of the invention is to reduce the incidents of missed appointments by providing an improved appointment card.

Another object is to provide an improved appointment card which affords a double reminder of the scheduled appointment.

Another object of the invention is to save staff time at the office of a service provider by minimizing the need for longhand writing on appointment cards.

Another object is to save patient time by providing an appointment card with a readily transferable adhesive sticker for the patient's calendar thereby eliminating the need to transcribe the appointment details.

Another object is to provide an improved appointment card which provides two separate reminders, yet requiring the appointment information to be entered only once, thereby eliminating transcription errors.

Another object is to transform the commonplace appointment reminder into a powerful tool for improving cash flow, minimizing costly no-shows, office efficiency and encouraging patient attendance.

Another object is to provide an improved appointment reminder which is economical to manufacture and efficient in operation.

Finally, a further object of the invention is to provide an improved method for reminding patients of scheduled appointments.

SUMMARY OF THE INVENTION

The dual impression appointment reminder of the present invention includes a base card and a label smaller than the base card but removably adhesively secured onto the base card so that the label may be removed and adhered to another surface. To simultaneously record appointment information on both the label and base card, the reminder includes means responsive to writing information on the label with an impression writing instrument for duplicating that information on a portion of the base card underlying the label.

In one embodiment, the reminder may be a two-ply form including a face stock releasably adhered to a release liner by adhesive on the bottom surface of the face stock with the face stock and liner being of such material that upon writing information on the face stock with an impression writing instrument, a copy of that information is simultaneously made on the liner. The label is thus a portion of the face stock and is defined by a peripheral die cut through the face stock only so that the label is removable. The base card in this embodiment would refer to the combination of the release liner and remainder of the face stock after removal of the label.

The portion of the face stock outwardly of the label has printed information permanently displaying the name and address of the service provider likewise, the label has the printed information on it including indicia for at least one service provider, notice of an appointment with the service provider and space for indicating with an impression writing instrument the date and time of the appointment. Similar printed information would be presented on the base card either at a position underlaying the label or adjacent to the label so that in the two-ply form embodiment the same information can be displayed with or without printing on the release liner. In either case, a single recording of appointment information on the label with an impression writing instrument effective for preparing two separate reminders, each with the date and time of the appointment recorded thereon.

Certain information such as a listing of several service providers, a listing of days of the week and/or AM/PM designators may be arranged adjacent respective edges of the label, with the face stock or base card including the same information outwardly of the label, but in adjacent aligned relation with the corresponding information on the label so that a single marking on the label is operative to designate a selection on both a label and base card.

The dual impression appointment reminder of the present invention can make a big difference both to service providers as well as to the individuals they serve. I consider the following benefits. The dual impression appointment reminder reduces missed appointments.

By minimizing missed appointments, the dual impression appointment reminder can help service providers to improve their cash flow and enhance their annual revenues.

The dual impression appointment reminder saves staff time by minimizing the need for longhand writing. The service provider's name can be indicated with a check mark. The day of the week and AM/PM designation can simply be circled.

Though the information is entered only once, the patient receives two reminders.

The dual impression appointment reminder saves the patient time as well, because transferring a label to a personal calendar can be done more quickly than handwriting the appointment details.

Because the patient need not copy information from an appointment card to a personal calendar, the dual impression appointment reminder assures accuracy and eliminates transcription errors.

The size and appearance of the dual impression appointment reminder, along with the selection of information provided on it, can readily be custom-tailed to the needs of any particular service provider or organization.

The visual impact of the label affixed in a personal planning calendar is more eye-catching than a pen-cilled-in appointment note.

Minimizing missed appointments helps to assure good follow-up patient care.

Finally, the dual impression appointment reminder promotes patient goodwill by providing a convenient memory jogger and by conveying an innovative, service oriented image.

DESCRIPTION OF THE PREFERRED EMBODIMENT

Figure 7:
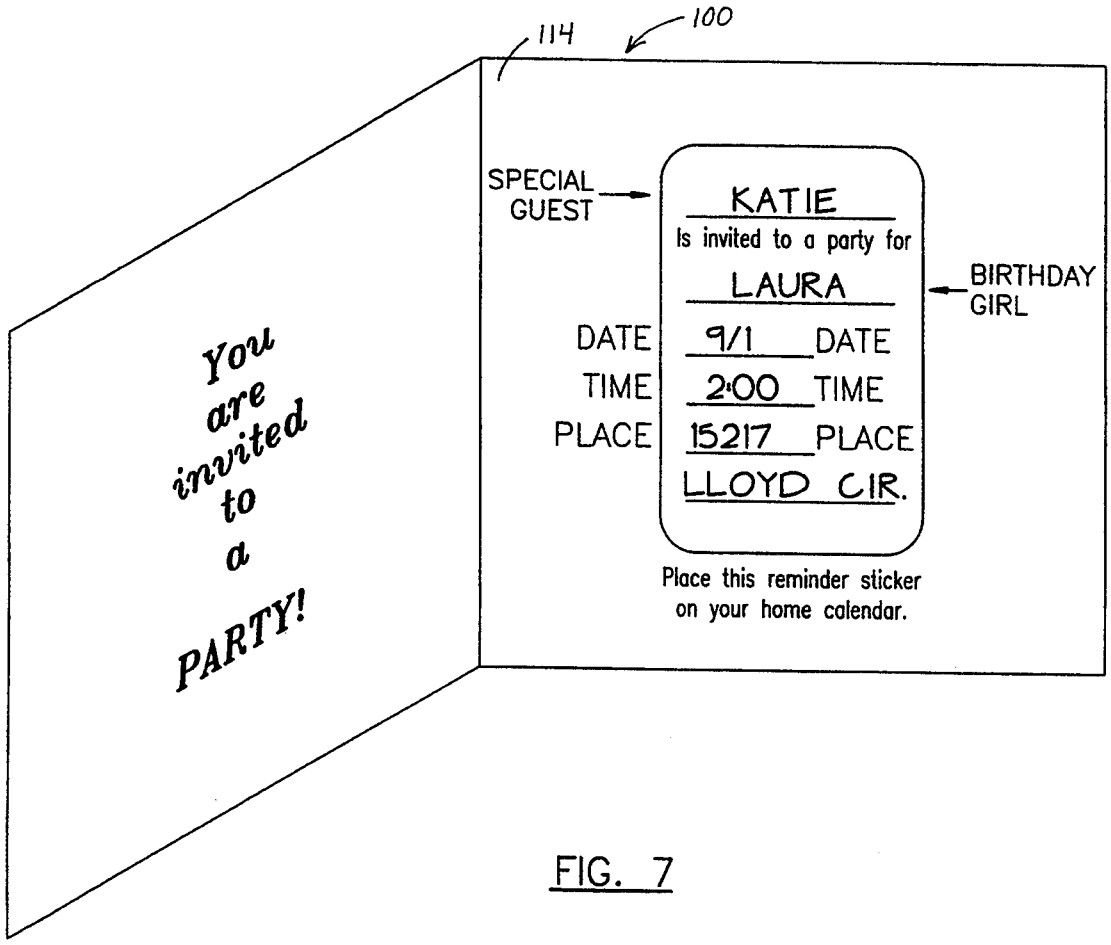
FIG. 7 is a perspective view of an alternate embodiment of the invention in the form of a party invitation with the party details written onto the label.
Figure 8:
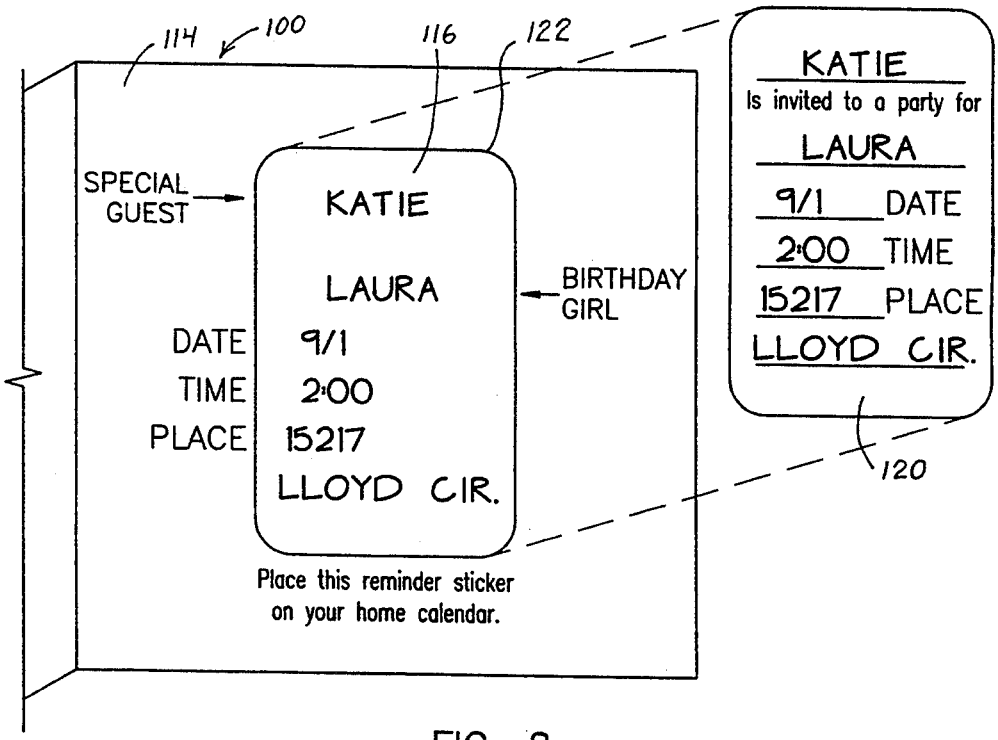
FIG. 8 is a foreshortened view of the base card portion of the party invitation of FIG. 7 with the label lifted off of the base card.

The dual impression appointment reminder of the present invention is illustrated in connection with a first embodiment 10 in FIGS. 1 through 3, a second embodiment 12 in FIG. 4 and a third embodiment 100 in FIGS. 7 and 8 in the form of a party invitation. Similar reference numerals will be used to describe like parts of the first and second embodiments.

The dual impression appointment reminder 10 is shown as a two-ply form including a face stock 14 having top and bottom surfaces, a release liner 16 of the same size and shape as the face stock 14 and underlaying the face stock 14, and adhesive 18 on the bottom surface of the face stock 14 releasably securing the face stock to the release liner 16.

The face stock 14 and liner 16 are of such material that, upon writing information on the top surface of stock 14 with an impression writing instrument such as a pencil, pen, typewriter, dot matrix or any impact printer, or the like, a copy of that information is simultaneously made on the liner 16. An acceptable two-ply form is commercially available from Kimberley-Clark with specific reference to a Kimberley-Clark/Brown-Bridge Product Specification identifying a 45# smudge-proof face stock, a B-82 adhesive and a black self-image liner. Another such two-ply form is a commercially available under the name LITHO LITE FAST COPY SS1 Adhesive SPEC #02078 from Fasson Role Division in Painsville, Ohio. Other suitable two-ply form with an adhesive backed top ply and data transfer capability between plies may be used.

In the preferred embodiments, the face stock 14 includes a label 20 which is at least partially designed by a peripheral cut 22 through the face stock 14 so that the pull-out label 20 is removable from the release liner 16 and the remainder of the face stock 14 so that it can be attached by the adhesive 18 on the bottom surface thereof to another surface such as a calendar page. Peripheral cut 22 is preferably spaced from four edges of the face stock 14, but could alternately be arranged in one corner, or any other desired position. The illustrated position is advantageous in the first embodiment to enable alignment of printed information on the label with printed information on the face stock surrounding the label.

Printed information on the face stock 14 outside the border of the label 20 includes a prominent display of the name, address and phone number of the service provider, as well as possibly a logo 24 to further identify the service provider and improve the aesthetics of the card 10. Other helpful printed information on the face stock may include use instructions, such as the text "Please affix this reminder sticker to your calendar" as appears above the label 20 as well as a diplomatically worded message 26, such as that indicated below the label 20 to encourage the patient to call if an appointment can't be kept.

The label likewise includes printed information, preferably enough to afford a complete independent reminder of the appointment, including the name and phone number of the service provider and spaces 28 and 30 for indicating with an impression writing instrument the date and time of an appointment. Spaces 28 and 30 may be designated by underlining as illustrated, or alternatively by boxes, background color variations or otherwise.

Figure 1:
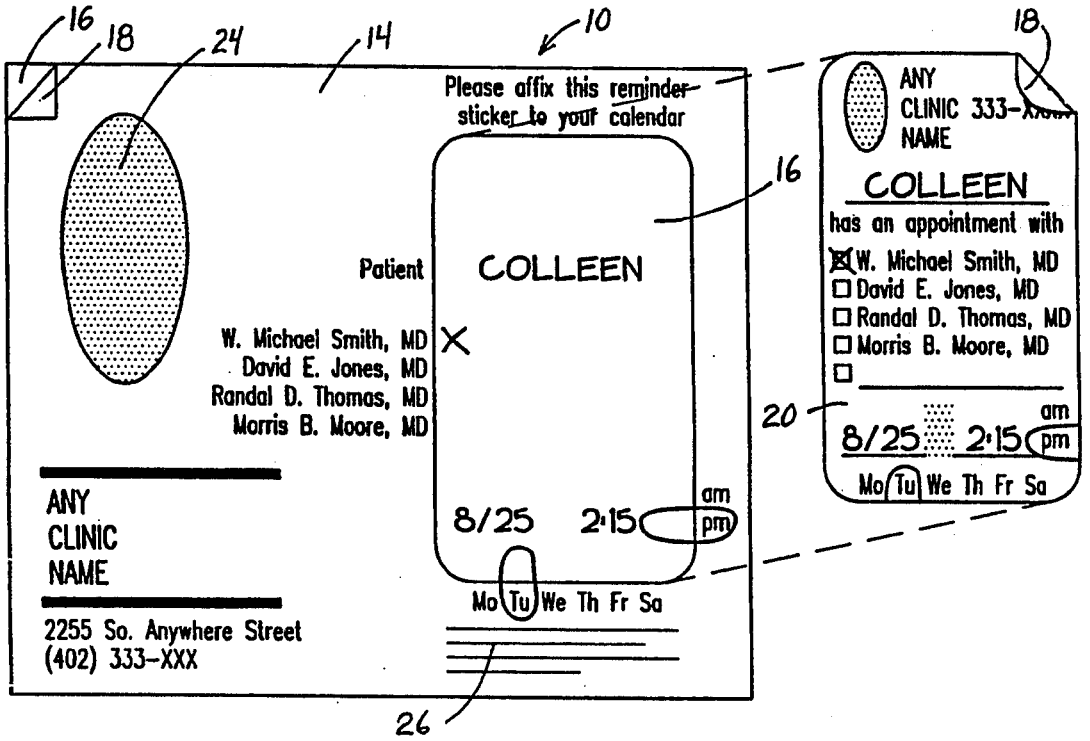
FIG. 1 is an exploded view showing the dual impression appointment reminder of the invention with appointment information recorded thereon and the label lifted from the base card.
Figure 2:
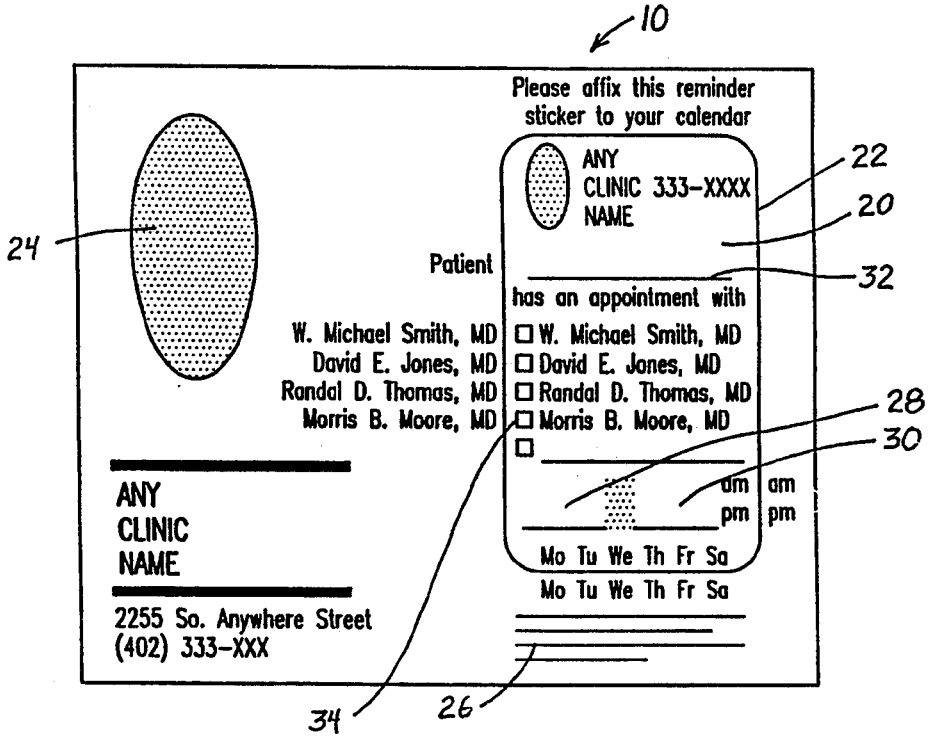
FIG. 2 is a front view of the dual impression appointment reminder with a label adhered onto the base card.
Figure 3:
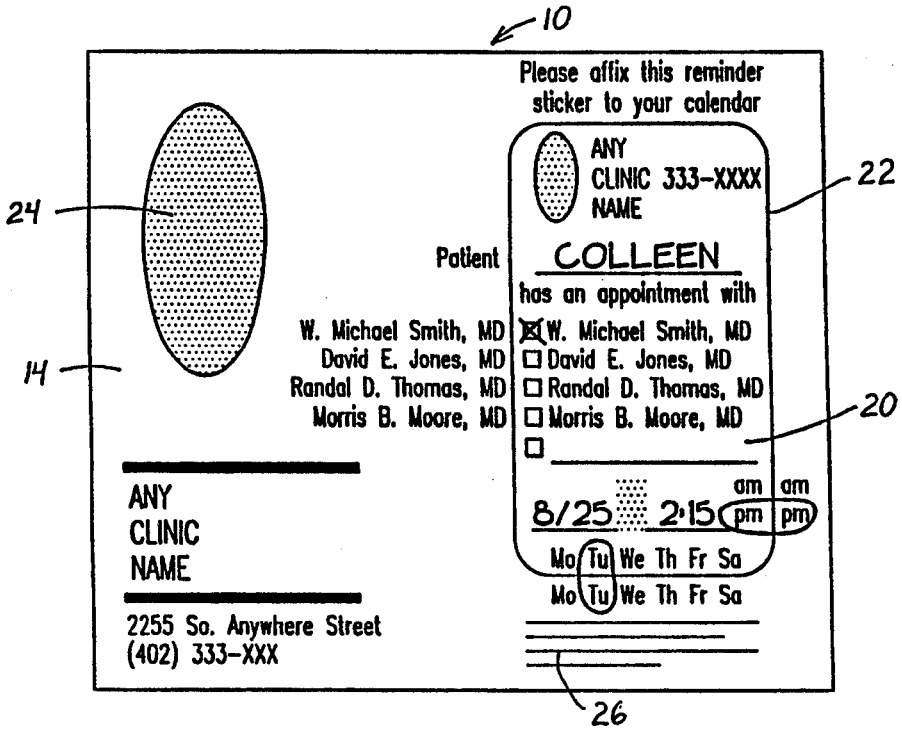
FIG. 3 is a front view of the dual impression appointment reminder, but with appointment information recorded thereon.

On the illustrated first embodiment of FIGS. 1–3, the listing of a plurality of service providers is presented at the center of the form with boxes next to their name for designating a selected one of them. For that instance, the name and logo at the top of the form refer to the clinic which includes all of the individual service providers. Above the listing of service providers, a line 32 or space is provided for entry of the patient's name below which there is a notice of appointment such as the words "has an appointment with" above the listing of service providers. Adjacent the space 30 for the time of the appointment, the label preferably bears AM/PM indicia, preferably adjacent one edge of the label. Adjacent another edge of the label are the day of the week indicia, such as "MO TU WE TH FR SA".

The most economical version of the tool impression appointment reminder of the invention will not have any permanent printed information on the release liner. Thus as shown in FIGS. 1-3, the face stock 14 also bears a listing of the same service providers as indicated on the label, but outwardly of the label, and in adjacent aligned relation with the listing on the label so that a single marking on the label will be operative to designate a selected service provider on both label and face stock. For this purpose, the check-off boxes 34 may be provided between the listings on the label and face stock. Similarly, day of the week indicia may be printed on the face stock outwardly of the label, but in adjacent aligned relation with the day of the week indicia on the label, again so that a single marking on the label will be operative to designate a selected day of the week in both the label and face stock. Finally, the face stock may be printed with AM/PM indicia outwardly of the label, but in aligned adjacent relation to the AM/PM indicia on the label for simultaneously selecting the AM or PM designation on both the label and face stock.

Referring to FIG. 3, completion of the dual impression appointment reminder is a simple two-step process as follows.

1. The office staff member writes the patient's name in the appropriate space, then indicates the practitioner with whom the appointment is scheduled by a check mark. The date and time are written in and the day of the week and the a.m./p.m. designation are indicated by circles.

2. All the pertinent appointment information provided on the original reminder card also appears on the label that is integral to the card. The patient or client can remove the label and affix it to a personal planning calendar, wall calendar or desk calendar. The original card may then be retained in purse or wallet, or may be given to another individual (such as a grandparent who will be taking a child to a doctor's or dentist's appointment).

It can be seen in FIG. 1 that the remaining cards, after removal of the label 20, presents a clear display on the identical written information on the release liner 16, which information is arranged relative to the surrounding text on the face stock 14 to effectively designate a selected service provider and designate the appropriate day of the week and AM/PM indicator.

The word "patient" is used to simplify the discussion herein, but it is to be construed as including a client, customer, patron or other purchaser of services. Likewise, the designation "service provider" in this context is meant to refer to either groups or individuals engaged in a professional practice or other business that routinely schedule appointments. Examples include physicians, audiologists, physical therapists, nutritionists, optometrist, dentists, psychologists, chiropractors, podiatrists, veterinarians, and hairstylists.

Figure 4:
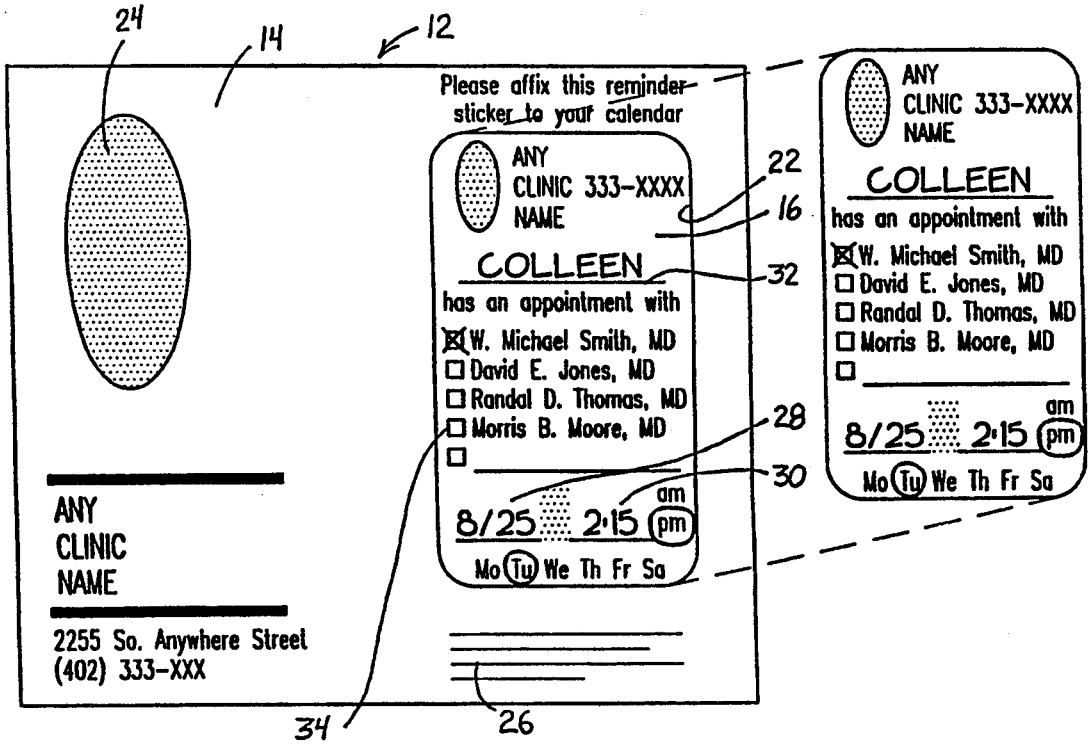
FIG. 4 is an exploded front view of an alternate embodiment of the invention wherein printed information is provided on the base card at a position underlaying the label so that the appearance of the reminder card appears essentially the same before and after removal of the label.

The second embodiment 12 shown in FIG. 4 is identical to the first embodiment 10, except that the portion of the release liner underlaying the label 20 has the same permanent printed information displayed on it as is displayed on the label 20. Accordingly, there is no need to duplicate that information on the portion of the face stock 14 surrounding the label.

Whereas size is not critical to the present invention, it is preferred that the appointment card have a height of between 4 and 8 centimeters and a width of between 8 and 4 centimeters. This size range will encompass the usual business card format as well as a slightly larger format so that the appointment card will stand out from and be distinguishable from other business cards with which it may be stored.

Figure 5:
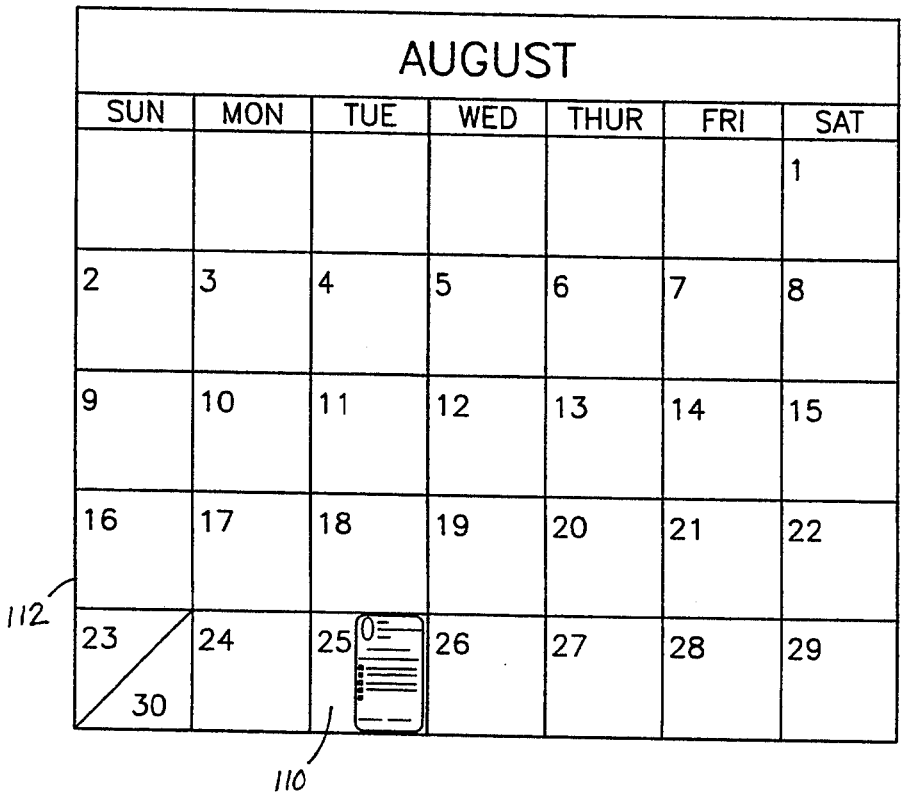
FIG. 5 is a front view of a one month calendar page bearing the label of the invention.
Figure 6:
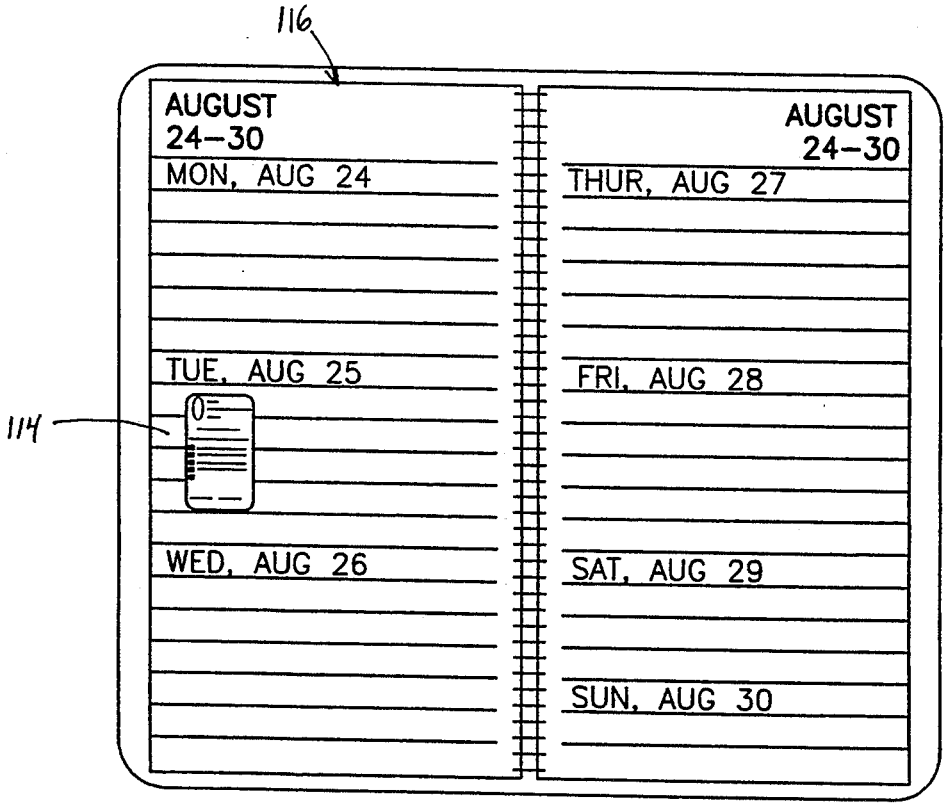
FIG. 6 is a front view of an open pocket calendar including the label of the invention adhered adjacent the designated date.

Whereas a application of the dual reminder of the invention is the appointment card for professional and business service providers, it has many additional applications. Businesses, for example, may send out invitations for an open house, for an organizational meeting, a showing of artwork or the like. Individuals may use such a card for party announcements or any other social invitations. FIGS. 7 and 8 illustrate a third embodiment 100 of the invention wherein the face stock 114 is likewise secured by adhesive to a release liner 116 and have a label 120 formed therein by a peripheral cut 122. In this instance, the name of the service provider, the "birthday girl" is simply designated by a line which may be completed by a purchaser of the card. The label 120 additionally includes lines labeled for insertion of the date, time and place of the event. Similar designators are arranged on the face stock 114 outwardly of the label 120 and in adjacent aligned relation with the corresponding information on the label, so that the single marking of date, time and place information on the label is operative to make a display of the same information on the underlying release liner which is visible after removal of the label as illustrated in FIG. 8. The removed label may then be adhered to the appropriate date 110 on a desk or wall calendar 112 as shown in FIG. 5, or to appropriate date 114 on the appropriate page of a pocket calendar 116 as illustrated in FIG. 6.

It is apparent that the present invention, in addition to disclosing an improved appointment card, invitation or the like, also teaches a new and improved method for reminding a patient of a scheduled appointment with a service provider. That method includes providing a dual impression appointment card of the present invention, indicating the date and time of a scheduled appointment on the label with an impression writing instrument thereby simultaneously recording the date and time on the portion of the card underlying the label, delivering the completed card to a patient, and instructing the patient to remove the label from the card and to adhere the label to another surface, such as a calendar to thereby have two reminders with the date and time on the appointment recorded thereon.

Whereas the dual impression appointment reminder card and method of the invention have been disclosed in connection with preferred embodiments thereof, it is understood that many additions, modifications and substitutions may be made within the intended broad scope of the appended claims. For example, a base card of paper, cardboard or the like may have a small adhesive backed label removably adhesively secured to it in a manner that the label may be removed and adhered to another surface. The reminder includes means responsive to writing information on the label with an impression writing instrument for duplicating that information on the portion of the base card underlying the label. With reference to first and second preferred embodiments 10 and 12, the base card refers to the combination of the release liner 16 and the remaining portion of the face stock 14 after removal of the label 20.

In the alternative, the base card may be a single ply stock paper of the type used for conventional business and appointment cards, and the label may be of the type commonly referred to in the art as a "piggyback label". That label has an adhesive backed label removably affixed to a release liner which itself is adhesively secured to the basecard. Upon writing information on the removable portion of the label, an image is transferred to the release liner. In this embodiment, the base card would be considered as including the single ply card stock as well as the release liner portion of the label.

The type and amount of information to be displayed or provided for on the card are discretionary with the particular service provider. Whereas a medical practice which provides primary care to families may want to include a line for entering the patient's name as indicated in the drawings, a specialty practice will most likely be treating only one member of a family so it would not likely need a space for entering the patient's name.

Whereas the reminder is illustrated as a separate single form, it is apparent that the appointment reminder cards may be produced as continuous forms with lines of perforations separating interconnected forms and a detachable strip of pin feed holes along one or both sides of the forms.

The printed information may be modified to provide for multiple appointment if desired. For example, in professions such as physical therapy psychiatry and others, it is the usual practice to schedule a series of appointments. Such a card may delete the AM/PM designations, day of the week indicia spaces for entry of a single date and time and replace those with a grid wherein each column would provide for entry of day, date and time information for a respective appointment and the number of columns would correspond to the maximum number of appointments that could be scheduled on the card.

Thus there has been shown and described a dual impression appointment reminder card and method which accomplish at least all of the stated objects.

I claim:

1. A dual impression appointment reminder for a service provider, comprising, a two-ply form including a face stock having top and bottom surfaces, a release liner and an adhesive on said bottom surface releasably securing said face stock to said release liner, said face stock and liner being of such material that upon writing information on said face stock with an impression instrument, a copy of that information is simultaneously made on said liner, said face stock including a label at least partially defined by a peripheral cut through said face stock whereby said label is removable from said release liner and the reminder of said face stock and attachable by the adhesive on the bottom surface thereof to another surface, said face stock having printed information on the top surface thereof including indicia at least one service provider, and said label having printed information thereon including indicia for at least one service provider and spaces for indicating with an impression writing instrument the date and time of an appointment on said label whereby, upon indicating said date and time on said label with an impression instrument and upon removal of said label from said liner, two reminders are provided with the date and time of an appointment recorded thereon, said label being adapted for adherence to another surface such as a calendar, the indicia for at least one service provider on said label being adjacent one edge of the label, said indicia for the name of said service provider on said face stock being positioned outwardly of said label, but in adjacent aligned relation with said indicia for at least one said service provider on said label whereby a single marking on said label is operative to designate said service provider on both said label and remaining form.

2. The dual impression appointment reminder of claim 1 wherein said two-ply form comprises a card having a height of between 4 and 8 centimeters and a width of between 8 and 12 centimeters.

3. A dual impression appointment reminder for a service provider comprising, a base card, a label smaller than said base card and having front and back surfaces, adhesive means on the back surface of said label removably adhesively securing said label on said base card so that said label may be removed and adhered to another surface, means responsive to writing information on said label with an impression writing instrument for duplicating said information on the portion of said base card underlying said label, said base card having printed information thereon including indicia for the name an address of the service provider, said label having printed information thereon including indicia for at least one service provider, notice of an appointment with said service provider and spaces for indicating with an impression writing instrument the date and time of an appointment on said label whereby, upon indicating said date and time on said label with an impression writing instrument and upon removal of said label from said base card, two reminders are provided with the date and time of an appointment recorded thereon, said label being attachable by said adhesive means to another surface such as a calendar; and wherein said printed information on said label includes a listing of a plurality of service providers adjacent one edge of the label, said base card likewise including the same listing of a plurality of service providers, outwardly of said label, but in adjacent aligned relation with said listing on said label whereby a single marking on said label is operative to designate a selected service provider on both said label and base card.

4. A dual impression appointment reminder for a service provider, comprising, a two-ply form including a face stock having top and bottom surfaces, a release liner and an adhesive on said bottom surface releasably securing said face stock to said release liner, said face stock and liner being of such material that upon writing information on said face stock with an impression instrument, a copy of that information is simultaneously made on said liner, said face stock including a label at least partially defined by a peripheral cut through said face stock whereby said label is removable from said release liner and the reminder of said face stock and attachable by the adhesive on the bottom surface thereof to another surface, said face stock having printed information on the top surface thereof including indicia for the name and address of said service provider, said label having printed information thereon including indicia for at least one service provider and spaces for indicating with an impression writing instrument the date and time of an appointment on said label whereby, upon indicating said date and time on said label with an impression writing instrument and upon removal of said label from said liner, two reminders are provided with the date and time of an appointment recorded thereon, said label being adapted for adherence to another surface such as a calendar; and wherein said printed information on said label includes a listing of a plurality of service providers adjacent one edge of the label, said face stock likewise including the same listing of a plurality of service providers, outwardly of said label, but in adjacent aligned relation with said listing on said label whereby a single marking on said label is operative to designate a selected service provider on both said label and remaining form.

5. The dual impression appointment reminder of claim 4 wherein the printed information on said label includes day of the week indicia printed adjacent one edge of the label, said face stock likewise including the same day of the week indicia outwardly of said label, but in adjacent aligned relation with said day of the week indicia on said label whereby a single marking on said label is operative to designate a selected day of the week on both said label and remaining form.

6. The dual impression appointment reminder of claim 5 wherein the printed information on said label includes AM/PM indicia printed adjacent one edge of the label, said face stock likewise including the same AM/PM indicia outwardly of said label, but in adjacent aligned relation with said AM/PM indicia on said label whereby a single marking on said label is operative to designate a selected AM/PM time on both said label and remaining form.

7. The dual impression appointment reminder of claim 6 wherein the printed information on said label provides notice of an appointment with the service provider indicated thereon at the date and time to be indicated in the spaces provided therefor.

8. The dual impression appointment reminder of claim 7 wherein the portion of said liner underlying said label is free of printed information thereon.

9. The dual impression appointment reminder of claim 7 wherein the portion of the liner underlying said label has the same printed information thereon as appears on said label.

10. The dual impression appointment reminder of claim 7 wherein said indicia for at least on service provider on said label comprises the printed name of said service provider.

11. A dual impression appointment reminder for a service provider comprising, a base card, a label smaller than said base card and having front and back surfaces, adhesive means on the back surface of said label removably adhesively securing said label on said base card so that said label may be removed and adhered to another surface, means responsive to writing information on said label with an impression writing instrument for duplicating said information on the portion of said base card underlying said label, said base card having printed information thereon including indicia for the name of the service provider, and said label having printed information thereon including indicia for at least one service provider, notice of an appointment with said service provider and spaces for indicating with an impression writing instrument the date and time of an appointment on said label whereby, upon indicating said date and time on said label with an impression writing instrument and upon removal of said label from said base card, two reminders are provided with the date and time of an appointment recorded thereon, said label being attachable by said adhesive means to another surface such as a calendar, the indicia for the name of the service provider on said base card being positioned in underlying relation to said label and in underlying registered relation with said indicia for at least one service provider on said label whereby a single marking on said label is operative to designate said service provider on both said label and remaining form.

12. The dual impression appointment reminder of claim 11 wherein the printed information on said label includes day of the week indicia printed adjacent one edge of the label, said base card likewise including the same day of the week indicia outwardly of said label, but in adjacent aligned relation with said day of the week indicia on said label whereby a single marking on said label is operative to designate a selected day of the week on both said label and base card.

13. The dual impression appointment reminder of claim 12 wherein the printed information on said label includes AM/PM indicia printed adjacent one edge of the label, said base card likewise including the same AM/PM indicia outwardly of said label, but in adjacent relined relation with said AM/PM indicia on said label whereby a single marking on said label is operative to designate a selected AM/PM time on both said label and base card.

14. The dual impression appointment reminder of claim 12 wherein the portion of said base card underlying said label is free of printed information thereon.

15. The dual impression appointment reminder of claim 12 wherein the portion of the base card underlying said label has the same printed information thereon as appears on said label.

16. The dual impression appointment reminder of claim 12 wherein said base card has a height of between 4 and 8 centimeters and a width of between 8 and 12 centimeters.

17. A method for reminding a patient of a scheduled appointment with a service provider, comprising providing a dual impression appointment reminder comprising a base card and a label smaller than said base card and removably adhesively secured onto said base card and means responsive to writing information on said label with an impression writing instrument for duplicating said information on the portion of said base card underlying said label, and wherein said label has a listing of a plurality of service providers adjacent one edge thereof and further providing a base card having a listing of the same service providers outwardly of the label but in adjacent aligned relation with the listing on the labels, and simultaneously designating a selected service provider on both said label and base card by making a single marking with an impression writing instrument on said label, indicating the date and time of a scheduled appointment on said label with an impression writing instrument thereby simultaneously recording said date and time on the portions of said card underlying said label, delivering said card to a patient, and instructing the patient to remove the label from said card and to adhere the label to another surface such as a calendar to thereby have two reminders with the date and time of the appointment recorded thereon.

18. The method of claim 17 wherein said step of making a single marking comprises checking a box adjacent the name of the selected service provider.

19. The method of claim 17 wherein said providing steps includes providing a label having day of the week indicia adjacent one edge thereof and a base card having the same day of the week indicia outwardly of the label but in adjacent aligned relation with said indicia on the label, and simultaneously designating a selected day of the week on both said label and base card by making a single marking with an impression writing instrument on said label.

20. The method of claim 19 wherein the step of simultaneously designating a day of the week comprises making a single marking with an impression writing instrument across the edge of the label adjacent the selected day of the week indicia on both said label and base card.

21. A dual impression appointment reminder for a service provider, comprising, a two-ply form including a face stock having top and bottom surfaces, a release liner and an adhesive on said bottom surface releasably securing said face stock to said release liner, said face stock and liner being of such material that upon writing information on said face stock with an impression instrument, a copy of that information is simultaneously made on said liner, said face stock including a label at least partially defined by a peripheral cut through said face stock whereby said label is removable from said release liner and the reminder of said face stock and attachable by the adhesive on the bottom surface thereof to another surface, said liner including a label portion underlying and adhered to said label, said label portion of said liner having printed information thereon including indicia for the name of said at least one service provider, and said label having printed information thereon including indicia for at least one service provider and spaces for indicating with an impression writing instrument the date and time of an appointment on said label whereby, upon indicating said date and time on said label with an impression instrument and upon removal of said label from said liner, two reminders are provided with the date and time of an appointment recorded thereon, said label being adapted for adherence to another surface such as a calendar, the indicia for at least one service provider on said label being adjacent one edge of the label, said indicia for the name of said service provider on said label portion of said liner being positioned in underlying relation to said label, and in underlying register relation with said indicia for at least one said service provider on said label whereby a single marking on said label is operative to designate said service provider on both said label and remaining form.

* * * * *